US011085626B2

(12) United States Patent
Zhang

(10) Patent No.: US 11,085,626 B2
(45) Date of Patent: Aug. 10, 2021

(54) APPARATUS FOR HEAT EXCHANGE BY USING BRAIDED FABRIC WOVEN FROM THERMALLY CONDUCTIVE WIRE MATERIAL

(71) Applicant: Yixing Zhang, Beijing (CN)

(72) Inventor: Yixing Zhang, Beijing (CN)

( * ) Notice: Subject to any disclaimer, the term of this patent is extended or adjusted under 35 U.S.C. 154(b) by 0 days.

(21) Appl. No.: 16/883,520

(22) Filed: May 26, 2020

(65) Prior Publication Data

US 2020/0284419 A1 Sep. 10, 2020

Related U.S. Application Data

(63) Continuation-in-part of application No. 15/760,504, filed as application No. PCT/CN2016/101041 on Sep. 30, 2016, now Pat. No. 10,697,624.

(30) Foreign Application Priority Data

Sep. 17, 2015 (CN) ..... 201510596062.8

(51) Int. Cl.
*F21V 29/70* (2015.01)
*F21V 29/65* (2015.01)
(Continued)

(52) U.S. Cl.
CPC ..... *F21V 29/70* (2015.01); *D04C 1/02* (2013.01); *D04C 1/06* (2013.01); *F21S 8/086* (2013.01);
(Continued)

(58) Field of Classification Search
CPC ..... F21V 29/70; F21V 29/503; F21V 29/65; F21V 29/89; F21V 29/60; F21V 29/67;
(Continued)

(56) References Cited

U.S. PATENT DOCUMENTS 2,433,239 A 12/1947 Rasero
6,018,459 A * 1/2000 Carlson ..... F28F 13/003 165/80.3
(Continued)

FOREIGN PATENT DOCUMENTS

CN 201062773 Y 5/2008
CN 201349385 Y 11/2009
(Continued)

*Primary Examiner* — Bao Q Truong
(74) *Attorney, Agent, or Firm* — Novick, Kim & Lee, PLLC; Allen Xue

(57) ABSTRACT

There are provided an apparatus for heat exchange by using a braided fabric woven from a thermally conductive wire material and a light emitting diode (LED) lighting device. The apparatus comprises a braided fabric (1) woven from a thermally conductive wire material, and a heat dissipating or absorbing object (2) is fixed with the braided fabric (1) by using methods such as welding, adhering with a thermally conductive adhesive and casting, so as to ensure that heat energy is effectively conducted between the heat dissipating or absorbing object (2) and the thermally conductive wire of the braided fabric (1), and heat is dissipated to air or absorbed from air by means of a heat dissipating surface of the thermally conductive wire of the braided fabric (1).

8 Claims, 6 Drawing Sheets

(51) Int. Cl.

| | |
|---|---|
| ***F21S 8/08*** | (2006.01) |
| ***F21V 29/503*** | (2015.01) |
| ***F21V 29/89*** | (2015.01) |
| ***F28F 13/00*** | (2006.01) |
| ***D04C 1/06*** | (2006.01) |
| ***D04C 1/02*** | (2006.01) |
| *F21Y 115/10* | (2016.01) |
| *F21W 131/103* | (2006.01) |

(52) U.S. Cl.
CPC ..... *F21V 29/503* (2015.01); *F21V 29/65* (2015.01); *F21V 29/89* (2015.01); *F28F 13/003* (2013.01); *D10B 2101/20* (2013.01); *D10B 2401/04* (2013.01); *F21W 2131/103* (2013.01); *F21Y 2115/10* (2016.08); *F28F 2255/02* (2013.01)

(58) Field of Classification Search
CPC .... D04C 1/02; D04C 1/06; F21S 8/086; F28F 13/003; F28F 2255/02; F21Y 2115/10; F21W 2131/103; D10B 2101/20; D10B 2401/04
See application file for complete search history.

(56) References Cited

U.S. PATENT DOCUMENTS

| | | | | |
|---|---|---|---|---|
| 2003/0178414 | A1 | 9/2003 | DeAngelis et al. | |
| 2010/0035000 | A1* | 2/2010 | Kirth ..... | D04C 1/06 428/35.2 |
| 2017/0198422 | A1 | 7/2017 | Ishikawa | |

FOREIGN PATENT DOCUMENTS

| | | | |
|---|---|---|---|
| CN | 201697079 | U | 1/2011 |
| CN | 104124331 | A | 10/2014 |
| CN | 204083890 | U | 1/2015 |
| CN | 204593143 | U | 8/2015 |
| CN | 105228423 | A | 1/2016 |
| CN | 205245105 | U | 5/2016 |
| EP | 2527730 | A1 | 11/2012 |
| JP | 2005085490 | A | 3/2005 |

* cited by examiner

APPARATUS FOR HEAT EXCHANGE BY USING BRAIDED FABRIC WOVEN FROM THERMALLY CONDUCTIVE WIRE MATERIAL

CROSS-REFERENCE TO RELATED APPLICATIONS

This application is a continuation-in-part of U.S. application Ser. No. 15/760,504, filed Mar. 15, 2018, which is the National Stage of International Application No. PCT/CN2016/101041, filed Sep. 30, 2016, which claims the benefit of priority from Chinese Patent Applications No. 201510596062.8, filed Sep. 17, 2015, the content of which is incorporated herein by reference in its entirety.

TECHNICAL FIELD

The present invention belongs to the field of heat conduction, in particular to a apparatus for heat exchange.

BACKGROUND

In general, the so-called heat dissipation is eventuality always to dissipate heat to air. However, whether convection or thermal radiation is related to the surface area of a heat dissipating surface of an object. Now, with the increase of a power of a heat generating element, in order to increase the surface area of the heat dissipating surface of a heat sink, the heat sink is becoming bigger and more bulky, but the efficiency is relatively low. In particular, a distance from the heat generating element to the heat dissipating surface is greatly increased while the heat dissipating surface is increased, such that the temperature difference required for heat transfer over this distance is also greatly increased. This makes heat dissipation of some elements such as a high-power LED chip reach at a dead end and currently become a key obstacle to rapid development of LED lighting.

As another aspect of heat exchange, heat absorption is exactly the same.

SUMMARY

In order to effectively solve the above problem, the present invention provides an apparatus for heat exchange by utilizing a braided fabric woven from a thermally conductive wire material, a specific technical solution of which is as follows.

There is provided an apparatus for heat exchange by utilizing a braided fabric woven from a thermally conductive wire material. The apparatus includes a thermally conductive braided fabric woven from a thermally conductive wire material with a diameter d, wherein 0.01 mm≤d≤2 mm; and a heat generating object or heat absorbing object is connected onto the thermally conductive braided fabric by means of welding, adhering with a thermally conductive adhesive and casting.

Further, the braided fabric as a whole includes a metal frame formed by die-casting or welding.

Further, the thermally conductive braided fabric as a whole has a pocket-like structure with an opening, and a blower is disposed at the opening.

Further, the thermally conductive braided fabric with the pocket-like structure is monolayer or multilayer.

Further, the thermally conductive braided fabric is fixed on an inner wall of a pipe needing heat exchange, and the inner wall of the pipe is made of a thermally conductive material.

Further, the thermally conductive braided fabric is fixed on an outer wall of the pipe capable of circulating air or other fluids, and the outer wall of the pipe is made of a thermally conductive material.

Further, the thermally conductive braided fabric is respectively fixed on an inner wall and an outer wall of the pipe capable of flowing air or other fluids, wherein the walls of the pipe are made of a thermally conductive material.

Further, the thermally conductive braided fabric is fixed on a first pipe needing heat exchange by using methods such as welding, adhering with a thermally conductive adhesive and casting, and the thermally conductive braided fabric is surrounded by a second pipe at the same time; and there is a height difference between the two pipes.

Further, the thermally conductive braided fabric is respectively fixed on inner walls of two pipes; the inner walls of the two pipes are made of a heat-conductive material and are integrally connected or in close contact.

There is provided an LED lighting device, including the above apparatus for heat exchange by utilizing a braided fabric woven from a thermally conductive wire material, wherein a heating element of the LED lighting device is an LED chip, and the LED chip is fixed on the thermally conductive braided fabric.

Further, There is provided an LED lighting device, including the above apparatus for heat exchange by utilizing a braided fabric woven from a thermally conductive wire material, wherein the LED chip and the thermally conductive braided fabric are both enclosed in a ventilation passage including pipe walls made of a thermally conductive material, a blower causes an air flow to flow through a gap of the thermally conductive braided fabric to take heat away, then the air flow is cooled by the pipe walls made of the thermally conductive material in the ventilation passage and recirculated back to cool the thermally conductive braided fabric and the LED chip fixed thereon; and in this way, the air flow for cooling is enclosed in the ventilation passage, and isolated from the outside world, so as to avoid pollution or other influences.

There is provided an LED lighting device, including the above enclosed ventilation passage, wherein the enclosed ventilation passage includes a lampshade, a hollow lamppost or a support rod, and heat is dissipated mainly by utilizing the lamppost or the support rod; and in this way, the air flow for cooling is enclosed in the lampshade, the hollow lamppost or the support rod, and isolated from the outside world, so as to avoid pollution or other influences.

In general, the so-called cooling is eventuality always to dissipate heat to air. Whether convection or thermal radiation is related to the surface area of a heat dissipating surface of an object. Surface areas of a copper pillar and a copper wire bunch a volume of which is the same as that of the copper pillar may differ by multiples of tens or even hundreds. Therefore, heat generated by a heat generating element can be rapidly transferred to a largest heat dissipating surface with the shortest distance, so that the heat is effectively dissipated. Considering that it is difficult to use and process a pile of disordered thermally conductive wire materials, it is possible to conveniently weave the thermally conductive wire materials into a braided fabric as needed, especially when it has a metal frame, for further processing and use.

As another aspect of heat exchange, heat absorption is exactly the same.

In the present invention, the apparatus for heat exchange is changed from a usual large and bulky aluminum profile into a braided fabric made of a small amount of metal wires, which makes it possible to considerably reduce a weight and a volume. This should be a fundamental change to the apparatus for heat exchange. For instance, when a heat sink is used for dissipating heat from a LED, the weight and volume of the heat sink may be compressed by at least ten times, so that a heat dissipation problem that has been hindered rapid development of the LED is fundamentally solved.

The apparatus for heat exchange of the present invention may be used for dissipating heat from an LED chip, may also be used for dissipating heat from various electronics, and may further be used for dissipating heat from and exchanging it with devices such as a heater, an air-conditioner, a refrigerator and a water heater.

DESCRIPTION OF DRAWINGS

FIG. 5A is a lamppost, a lampshade and an LED lamp of a street lamp shade, FIG. 5B is a lampshade and an LED lamp;

Figure 1:
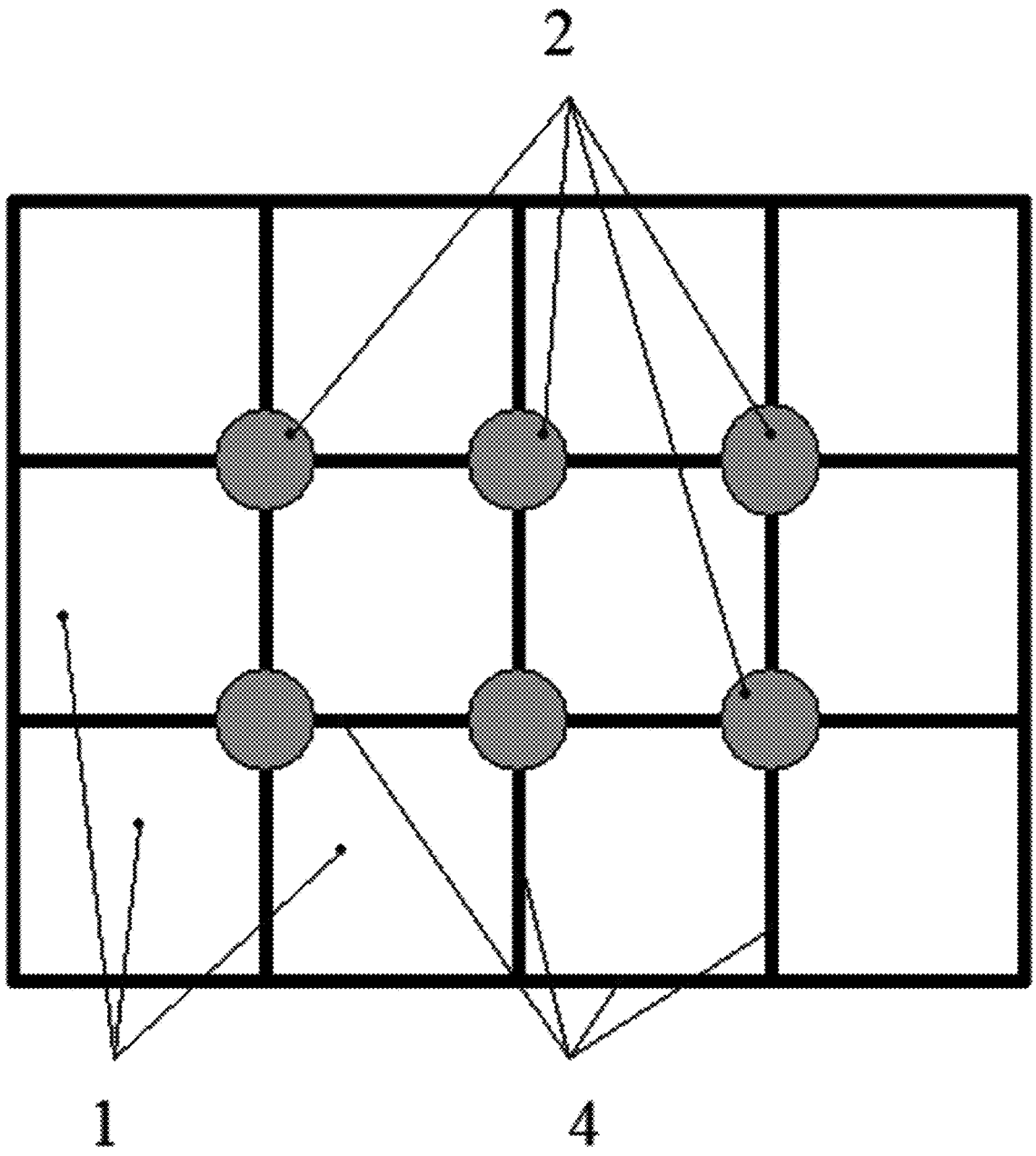
FIG. 1 is a die-cast metal frame and an LED chip on a braided fabric made of a copper wire.

wherein 1 represents a braided fabric made of a thermally conductive material, 2 represents an LED chip, 3 represents a blower, 4 represents a metal frame, 5 represents a first pipe, 6 represents a second pipe, 7 represents a lampshade, 8 represents a lamp post, and 9 represents a plastic pipe; and a unit of dimensioning is millimeter.

DETAILED DESCRIPTION OF EMBODIMENT

The technical scheme is mainly put forward mainly based on the following five considerations.

(1) People often encounter problems of heating and heat dissipation, for example, only less than ⅓ of the electric energy consumed by an LED is converted into visible light during the operation of the LED, while all of the rest electric energy is converted into heat. If the heat can't be dissipated, it will accumulate over time. The accumulation of heat on an object results in temperature rise of the object.

After a heat generating component starts to work, it is inevitably that the heat is accumulated continuously, causing continuously increased temperature of the heat generating component. Here, the temperature rise Δt, the increment of heat ΔQ, and the heat capacity C of the heat generating component have the following relationship among them:

$$\Delta t = \Delta Q / C$$

As the temperature is increased, the heat generating component will dissipate heat in the form of convection, irradiation, and conduction, i.e., transfer the heat away. Moreover, as the temperature is increased, the heat dissipation ability becomes stronger, till a temperature is reached such that the rate of heat dissipation is equal to the rate of heat generation of the heat generating component and a new balance is reached. At the balance point: when the temperature rise is higher, the heat dissipation will be increased, and thereby the heat dissipation rate will be higher than the heat generation rate, thus the amount of accumulated heat will be reduced and consequently the temperature will drop; on the contrary, when the temperature rise is lower, the heat dissipation will be reduced, and thereby the heat dissipation rate will be lower than the heat generation rate, thus the amount of accumulated heat will be increased and the temperature will rise accordingly. As a result, the temperature is automatically kept near the balance point, and thereby dynamic balance is achieved. The balance can always be achieved as long as the heat generating component is not burnt out owing to excessively high temperature. The only difference lies in that the temperature increase is different when the balance is reached for different heating power values and different heat dissipation effects.

Heat generation, although reflected by temperature rise, is actually the accumulation of heat in an object; heat dissipation, although utilized for a purpose of controlling the temperature of an object below a defined temperature limit, essentially is to increase the ability of the object for transferring heat to the ambient air, i.e., by increasing the power of heat radiation under a defined limit of temperature rise, so that the heat dissipation rate becomes equal to the heat generation rate of the heat generating component below the temperature limit to achieve dynamic balance.

Heat dissipation usually is to dissipate heat into the air. A heat generating component transfers heat to a heat-conducting material, which heats up the air by means of its surface contacting with the air. As the air flows, new air is heated up and carries away the heat continuously. That is heat dissipation by convection. Apparently, a sufficiently large heat dissipation surface is an indispensable prerequisite to ensure the normal heat dissipation of a heat dissipating device.

(2) Temperature difference is required for heat transfer: temperature difference is required for heat dissipation into the air, and temperature difference is also required for heat conduction in the heat-conducting material since the heat is inside the radiator. It should be noted that heat conduction is different from electric conduction. Don't imagine that a heat-conducting material can conduct heat away as long as the heat source is in contact with the heat-conducting material. Simple calculations demonstrate that it is not easy to conduct heat through a heat-conducting material even if the heat-conducting material has high heat-conducting performance.

We found that this fact is often ignored by people, and the temperature difference required for heat conduction in the heat-conducting material is often the main part of the temperature rise when the heat generating object operates.

For example, pure silver, which has the best heat-conducting performance, has 427 [W/m·K] thermal conductivity, which, when converted to the unit of millimeters in length, means that 2.34° C. temperature rise will occur on a silver column with 1 $mm^2$ cross-sectional area in every 1 millimeter distance when 1 watt heat power is conducted through the silver column. As for the brass material (with 109 W/m·K thermal conductivity) mentioned in the reference document 2, the temperature rise will be 9.17° C. That is only a case of 1 watt heat power conduction in 1 mm distance. In contrast, more than half (more than 60%) of the electric energy consumed by a high-power LED is converted to heat, and the heat to be transferred can be as high as tens of watts or more. It is imaginable how bad the case is. Besides, the allowable temperature rise of the heat dissipation surface of an LED chip carrier is only tens of degrees (e.g., 30° C.), and such a limit is too easy to be exceeded. Simple calculations demonstrate: for a high-power LED chip, if it is required that the temperature rise of the LED chip shouldn't exceed the allowable limit, the allowable distance of heat conduction through the heat-conducting material of the heat dissipating device can only be at the level of millimeters at the most, even if copper (or aluminum) is used as the heat-conducting material.

The heat dissipation surface may be increased by increasing the size of the heat dissipating device or making the heat dissipating device into a complex shape, but the distance between the heat generating component and the heat dissipating surface will also be increased, and thus the heat resistance of heat transfer will be increased. As a result, increased heat dissipation surface will inevitably lead to increased heat conduction resistance inside the heat dissipating device, which leads to a dead end in the solution of some heat dissipation problems. In addition, forced ventilation is also of no help since the cause for temperature rise associated to heat conduction is inherent in the heat-conducting material. Therefore, the solution to the heat dissipation problem of a high-power LED ultimately lies in what method can be used to conduct the heat inside the heat radiator to a sufficiently large heat dissipation surface through the shortest distance, i.e., against the smallest heat resistance.

(3) According to the common sense of geometry, the volume of a cylinder with radius r and height h is $$V=\pi r^2 h.$$

And its side area is $$S=2\pi rh.$$

Therefore, under the condition of a given volume of cylinder, the area of the cylindrical surface is inversely proportional to the radius.

For example, for a high-power LED lamp bead with a heat dissipation surface in 6 mm diameter, suppose a copper column in 6 mm diameter and 1 m (i.e. 1,000 mm) length is used to dissipate heat, in order to provide a heat dissipation surface that is large enough. Since a single lamp bead requires a copper column in 1 m length for heat dissipation, a lamp having power as high as tens of watts or even hundreds of watts has dozens of lamp beads and requires dozens of copper columns for heat dissipation, which are bulky and cumbersome. Moreover, since the maximum distance from the chip to the heat dissipation surface is 1 m, the heat resistance is very large, and the temperature rise will exceed the allowable limit of temperature rise. If 10,000 copper wires in 0.06 mm diameter and 1,000 mm length are used for heat dissipation, the total volume and mass of the copper wires are the same as those of a copper column, but the total heat dissipation area is greater by 100 times. If only the same heat dissipation surface is required, the length of the copper wires may be reduced from 1 m to 1 cm, i.e., reduced to 1/100. Here, the heat resistance against heat transfer from the chip to the heat dissipation surface and the required temperature difference are reduced to 1/100 of the original values respectively. If the original temperature rise was 1,000° C., (the LED will definitely be burnt), the temperature rise is only 10° C. now (low enough to ensure that the temperature rise does not exceed the allowable limit). Now, each chip only requires copper wires in 1 cm length for heat dissipation. Although there are 10,000 copper wires, the total volume is very small.

(4) However, it is not easy to ensure that the 10,000 thin copper wires and LED chips are well fixed together. Therefore, the method put forth in the claim 1 is used, i.e., the heat-conducting wires are woven into a wire fabric, "the heat-conducting fabric is fixed together with a heat-dissipating or heat-absorbing object by welding, bonding with heat-conducting adhesive, casting, or other methods in a way that heat can be conducted effectively between the heat-generating or heat-absorbing object and the heat-conducting wires of the heat-conducting fabric, the heat is conducted on the heat-conducting wires of the heat-conducting fabrics, so that air or a different fluid is heated or cooled by the surface of the heat-conducting wires, and the heat is dissipated or absorbed by convection".

The modern textile technology enables fabrics to have very complex fabric structures, such as fluff structures. One side of such a fabric has a relatively flat cloth surface structure, while the other side has fluffs in length of several millimeters or more.

If the heat-conducting fabric employs a fluff structure, the heat generating component is fixed on the flat side by welding, bonding with heat-conducting adhesive, casting, or other methods in a way that heat can be conducted effectively between the heat generating object and the heat-conducting wires (fluffs on the other side) of the heat-conducting fluff fabric, the heat is conducted on the heat-conducting wires (fluffs) of the fluff fabric, the air or another fluid is heated up by the surfaces of the heat-conducting wires, and thus heat dissipation is realized by convection.

In addition, a towel structure, especially a double-layer textile structure, may be used to weave the desired heat-conducting fabric. By selecting an appropriate fabric structure and relevant parameters and selecting an appropriate method of connection with the heat generating device, the best heat dissipation effect can be obtained, thus an ideal device for heat exchange using the heat-conducting wire fabric can be obtained.

Besides, the preparation process of the heat-conducting fabric is simple and easy, and is very suitable for mass preparation. As described above, in order to minimize the temperature difference required for heat conduction, the heat-conducting wires should be short as far as possible, usually at the level of millimeters. But the required quantity is huge, up to of thousands of heat-conducting wires. If heat-conducting wires are directly used, it will be very difficult to fix thousands of thin wires in length of several millimeters with the heat generating device, with the relative positions and the clearances, etc., taken into account. However, with a heat-conducting woven fabric, the heating device may be fixed to the woven fabric simply, and the processing is very easy. Moreover, the woven fabric may be made into required shape and size simply by cutting. Therefore, by using the heat-conducting woven fabric, the processing and manufacturing of the heat exchange device are very easy.

In that way, according to the present application, with the heat-conducting woven fabric, the heat generating device can contact with thousands of thin heat-conducting wires, and the heat can be transferred to a sufficiently large heat-dissipating surface through a very short distance along the thin wires. Thus, only a small temperature difference is required, and the volume (mass) of the required heat-conducting wires is small, i.e., the entire heat-dissipating device is be very light and small. The "device for heat exchange using a heat-conducting wire fabric" according to the present application will have stable and the best heat dissipation effect. Besides, by using the heat-conducting woven fabric, the processing and manufacturing of the heat exchange device are very easy.

(5) According to the present application, in the heat-conducting wire fabric, a large quantity of heat-conducting wires are crisscrossed and woven together, and the clearances among the transverse and longitudinal heat-conducting wires are surely uneven and disordered. However, it is found: as long as there is certain air flow velocity on the heat dissipating surfaces, the size of the clearance among the surfaces of the heat-conducting wires has little or no influence on the heat dissipation. The reason is that the heat conductivity coefficient of the air is extremely low, about $1/10{,}000^{th}$ of the heat conductivity coefficient of metallic aluminum (the heat conductivity coefficient of pure aluminum is 236 (W/m·K), while the heat conductivity coefficient of the air is $2.59\times10^{-2}$ (W/m·K)). Therefore, it is impossible to achieve effective heat transfer in the air by heat conduction; instead, heat is transferred in the air mainly by air convection, i.e., by air flow. In the convective heat transfer process, owing to the fact that the heat conductivity coefficient of the air is extremely low, only a very thin layer of flowing air adjacent to the surface of the heat conducting material is heated up, while the air slightly away from the surface of the heat conducting material is carried away by the air flow before it can be heated up. Thus, it is unnecessary to worry about the uneven and disordered clearances among the heat-conducting wires of the heat-conducting fabric, which is the basic guarantee for the heat dissipation device of the claim 1 to achieve an ideal heat dissipation effect.

An object of the present invention is to provide an apparatus for heat exchange by utilizing a braided fabric woven from a thermally conductive wire material. The apparatus is characterized by including a thermally conductive braided fabric woven from a thermally conductive wire material with a diameter of more than 0.01 mm and less than 2 mm. The thermally conductive braided fabric 1 is fixed with a heat generating object or a heat absorbing object by means of methods such as welding, adhering with a thermally conductive adhesive and casting so as to ensure that heat may be effectively conducted between the heat generating object or the heat absorbing object and the thermally conductive material of the thermally conductive braided fabric 1, the heat is conducted on the thermally conductive wire material of the thermally conductive braided fabric 1, and air or other fluids are heated or cooled by means of a surface of the thermally conductive wire material, and the heat is dissipated or absorbed by convection.

A metal frame 4 may be formed on the thermally conductive braided fabric 1 of the present invention by using methods such as casting or welding, so as to maintain a certain shape and structure for other processing.

The apparatus for heat exchange according to the present invention is characterized in that an element required to be subjected to heat dissipation or absorption is fixed on a braided fabric or its metal frame by using methods such as welding and adhering with a thermally conductive adhesive so as to ensure that heat can be effectively conducted between the element required to be subjected to heat dissipation or absorption and the thermally conductive wire material of the braided fabric; the heat is conducted on the thermally conductive wire material of the braided fabric 1, and air or other fluids are heated or cooled by means of a surface of the thermally conductive wire material, the heat is dissipated or absorbed by convection, and heat dissipation or absorption of the element required to be subjected to heat dissipation or absorption is finally realized.

The apparatus for heat exchange according to the present invention is characterized in that the braided fabric made of the thermally conductive wire material forms a pocket-like structure along or together with other materials, a blower is installed at an opening of a pocket to supply air into the pocket and blow it from a gap of the braided fabric, such that a heat dissipating surface of the thermally conductive wire material of the braided fabric may greatly heat or cool air to realize effective heat dissipation or absorption.

The apparatus for heat exchange according to the present invention is characterized in that the braided fabric made of the thermally conductive wire material may be multilayer, and may have various structures. Air passes in or out from the gap of the thermally conductive wire material of the braided fabric to realize heat exchange; and the other materials forming the pocket may also have appropriate structures so as to ensure that the air can be uniformly blown from the braided fabric.

The apparatus for heat exchange according to the present invention is characterized in that the braided fabric is fixed on an outer wall of a pipe needing heat exchange by using methods such as welding, adhering with a thermally conductive adhesive and casting, the outer wall of the pipe is made of a thermally conductive material, a metal frame of the braided fabric may be a portion of the outer wall of the pipe, or may be in close contact with the thermally conductive material of the outer wall of the pipe, so as to ensure that heat can be effectively conducted between the pipe needing heat exchange and the thermally conductive wire material of the braided fabric; the heat is conducted on the thermally conductive wire material of the braided fabric, and air or other fluids which are in contact with a surface of the thermally conductive wire material are heated or cooled by means of the surface, the heat is dissipated or absorbed by convection, and heat exchange between the outer wall of the pipe and the air or other fluids outside the pipe is finally realized.

The apparatus for heat exchange according to the present invention is characterized in that the braided fabric made of the thermally conductive wire material is fixed on an inner wall of a pipe capable of circulating air or other fluids, the inner wall of the pipe is made of a thermally conductive material, a metal frame of the braided fabric may be a portion of the inner wall of the pipe, or may be in close contact with the thermally conductive material of the inner wall of the pipe, so as to ensure that heat can be effectively conducted between the pipe needing heat exchange and the thermally conductive wire material of the braided fabric; the heat is conducted on the thermally conductive wire material of the braided fabric, and air or other fluids which are in contact with a surface of the thermally conductive wire material are heated or cooled by means of the surface, the heat is dissipated or absorbed by convection, and heat exchange between the outer wall of the pipe and the air or other fluids inside the pipe is finally realized.

The apparatus for heat exchange according to the present invention is characterized in that the braided fabric made of the thermally conductive wire material is respectively fixed on an outer wall and an inner wall of a pipe capable of circulating air or other fluids, the walls of the pipe are made of a thermally conductive material, metal frames inside the pipe and outside the pipe as well as of the braided fabric may be in close contact with the thermally conductive material of the walls of the pipe, or may be a portion of the walls of the pipe, so as to ensure that heat can be effectively conducted between the pipe and the thermally conductive wire material of the braided fabric; the heat is conducted on the thermally conductive wire material of the walls of the pipe and that of the braided fabric at two sides of the pipe, and air or other fluids which are in contact with surfaces of the thermally conductive wire materials of the braided fabric inside and outside the walls of the pipe and the braided fabric at two sides of the pipe are heated or cooled by means of these surfaces, heat exchange with air or other fluids which are in contact with these surfaces is realized by convection, and finally the heat is conducted through the walls of the pipe, and heat exchange between the air or other fluids inside the pipe and the air or other fluids outside the pipe is realized.

The apparatus for heat exchange according to the present invention is characterized in that the braided fabric is fixed on a pipe 1 needing heat exchange by using methods such as welding, adhering with a thermally conduction adhesive and casting, and the whole braided fabric is in turn surrounded by another pipe 1; there is a height difference between an inlet and an outlet of the pipe 2, a differential pressure is produced by using a principle of thermal expansion and contraction of air to promote the air to circulate so as to realize convection and heat exchange; and the pipe 2 may be further provided with a blower, so as to enhance a heat exchange effect.

The apparatus for heat exchange according to the present invention is characterized in that the braided fabric made of the thermally conductive wire material is respectively fixed on inner walls of two pipes, the walls of the two pipes are made of a thermally conductive material, and are integrally connected or in close contact; metal frames of the braided fabric at two sides of each of the pipes are all in close contact with the thermally conductive material of the walls of each of the pipes, or may be a portion of the walls of the pipes, so as to ensure that heat can be effectively conducted between the pipes and the thermally conductive wire material of the braided fabric; the heat is conducted on the thermally conductive wire material of the walls of the pipes and that of the braided fabric at two sides of each of the pipes, and air or other fluids which are in contact with surfaces of the thermally conductive wire materials inside the walls of the two pipes and those of the respective braided fabric are heated or cooled by means of these surfaces, heat exchange with air or other fluids which are in contact with these surfaces is realized by convection, and finally the heat is conducted through the walls of the pipes, and heat exchange between the air or other fluids inside the two pipes and the air or other fluids outside the two pipes is realized.

The apparatus for heat exchange according to the present invention is characterized in that the LED chip and the thermally conductive braided fabric are both enclosed in a ventilation passage including pipe walls made of a thermally conductive material, a blower causes an air flow to flow through a gap of the thermally conductive braided fabric to take heat away, then the air flow is cooled by the pipe walls made of the thermally conductive material in the ventilation passage and recirculated back to cool the thermally conductive braided fabric and the LED chip fixed thereon; in this way, the air flow for cooling is enclosed in the ventilation passage, and isolated from the outside world, so as to avoid pollution or other influences.

The apparatus for heat exchange according to the present invention is characterized in that its closed ventilation passage includes a lampshade, a hollow lamppost or a support rod, and heat is dissipated mainly by utilizing the lamppost or the support rod; and in this way, the air flow for cooling is enclosed in the lampshade, the hollow lamppost or the support rod, and isolated from the outside world, so as to avoid pollution or other influences.

[Embodiment 1] an LED Lamp with a Power of 80 W

On a thermally conductive fabric 1 woven from a copper wire, a metal frame 4 is formed by using a die-casting method to obtain a drum.

One end of the drum is blocked by using a braided strap or other materials, and the other end is connected with a blower 3. An LED chip 2 is adhered on the metal frame 2 by using a thermally conductive adhesive. The blower 3 and the LED chip 2 are connected to obtain an LED lamp with a power of 80 W.

Figure 2:
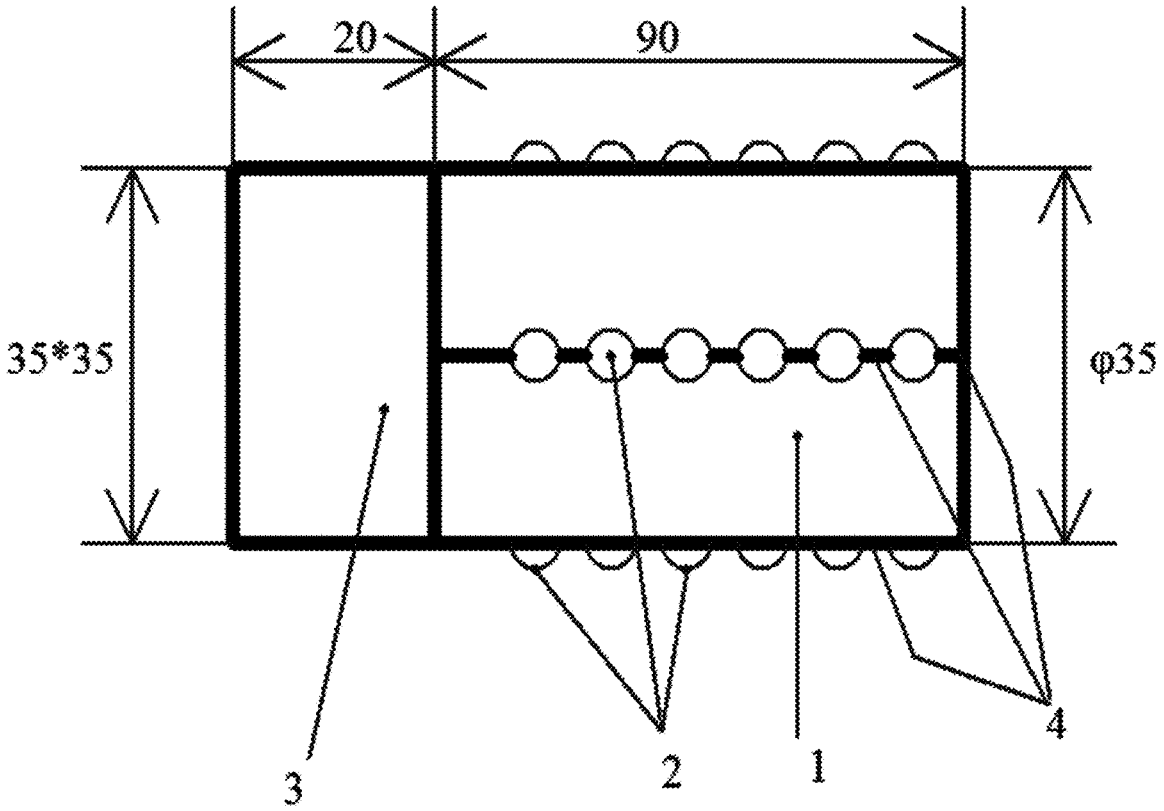
FIG. 2 is a structure of an LED lamp with a power of 80 W.

Maximum dimensions of a length, a width and a height of this LED lamp are 100 (mm)×40 (mm)×40 (mm). (See FIG. 2)

During steady operation, a temperature rise of a heat dissipating surface (back face) of the LED chip ranges from 25 DEG C. to 28 DEG C.

[Embodiment 2] an LED Lamp with a Power of 40 W

On a thermally conductive fabric 1 woven from a copper wire, a metal frame 4 is formed by using a die-casting method to obtain a frustoconical drum. One end of the frustoconical drum is blocked by using a braided strap and the other end is connected to a blower 3. An LED chip 2 is adhered on the metal frame by using a thermally conductive adhesive. The blower 3 and the LED chip 2 are connected to obtain an LED lamp with a power of 40 W.

Figure 3:
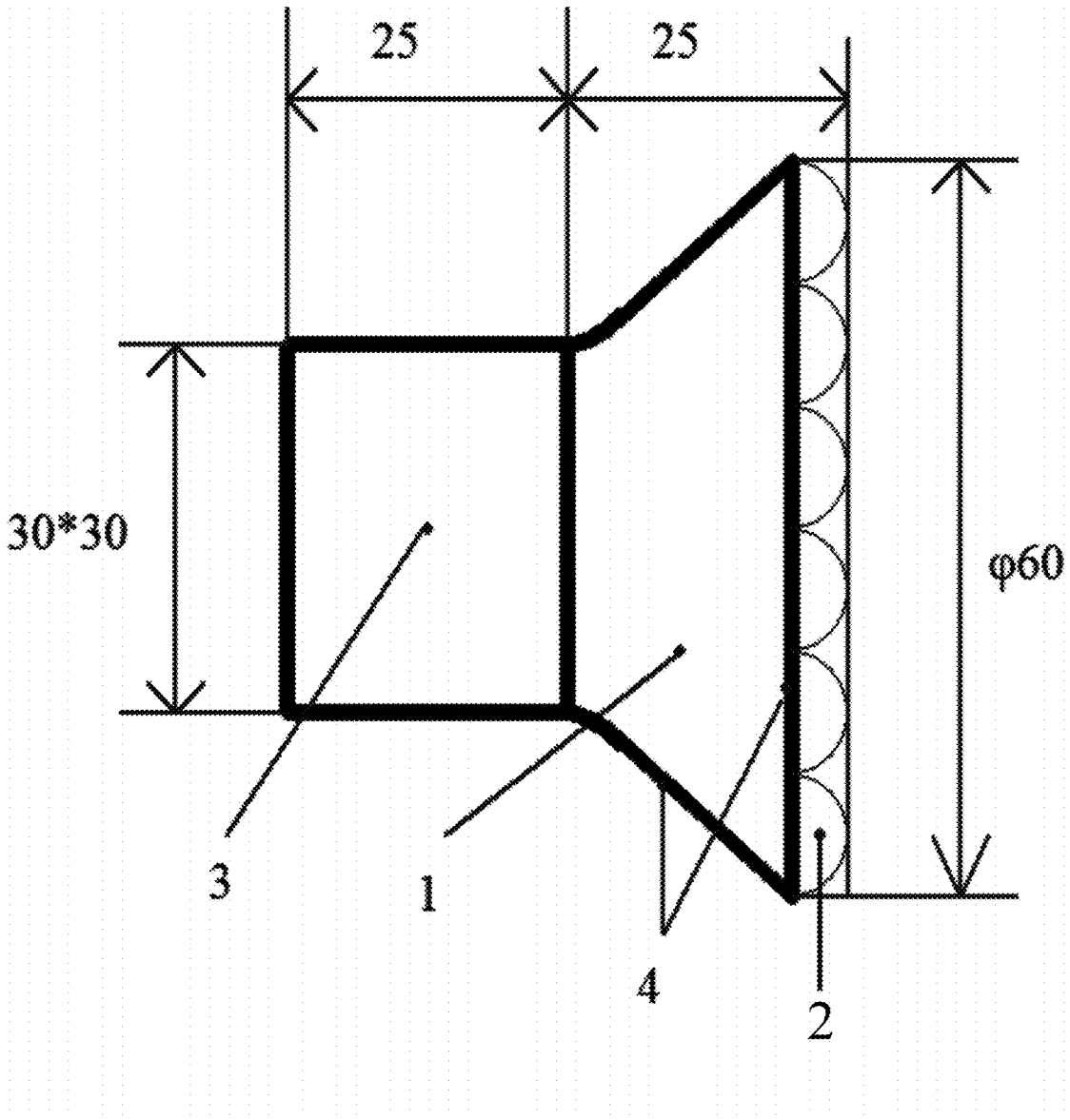
FIG. 3 is a structure of an LED lamp with a power of 40 W.
Figure 4:
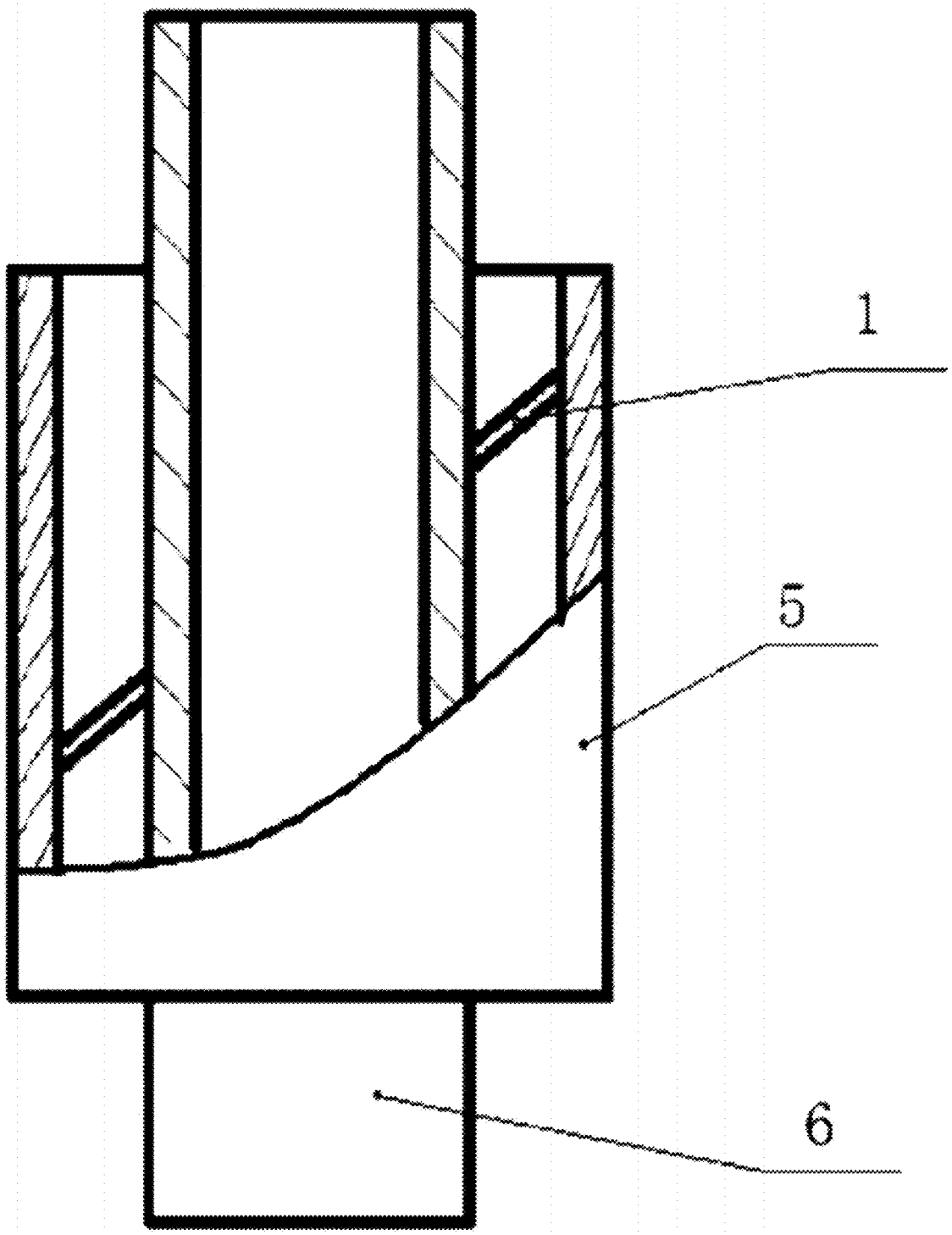
FIG. 4 is an apparatus for heat exchange.
Figure 5A:
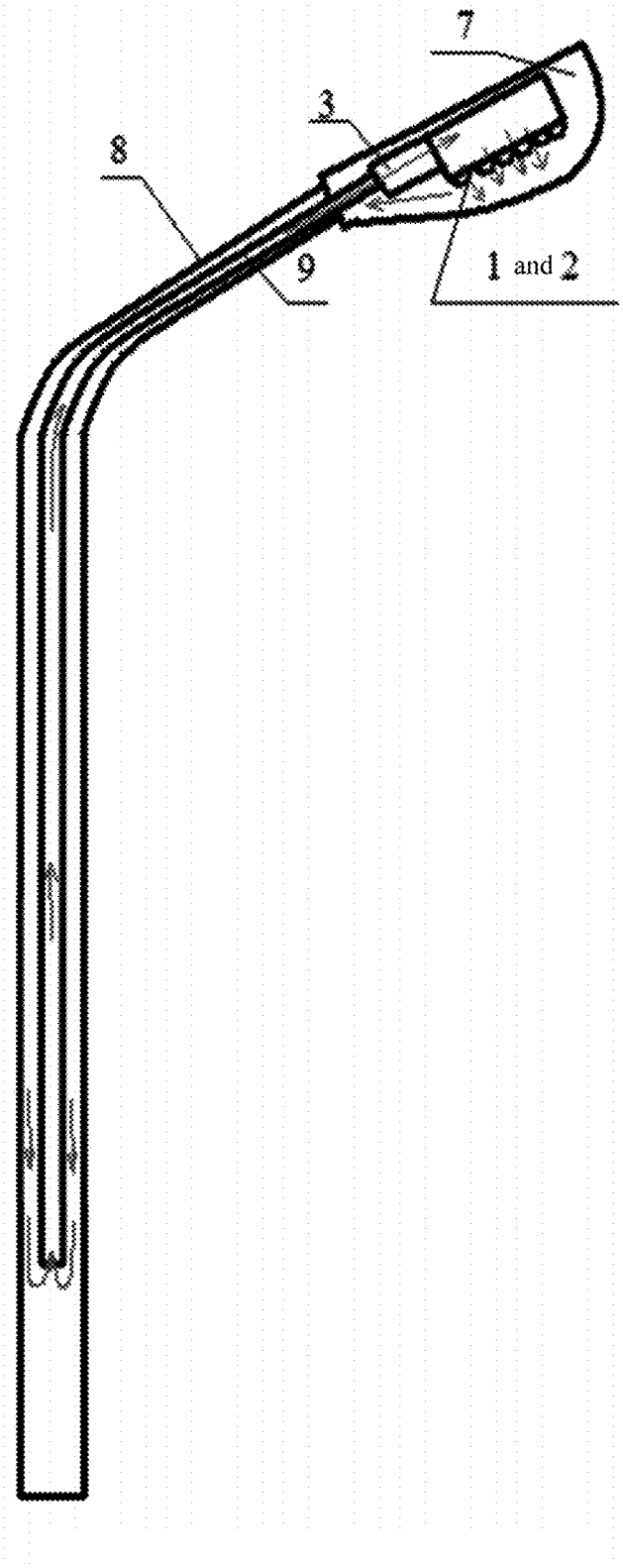
FIGS. 5A and 5B are a schematic diagram showing a structure of an LED street lamp with a power of 100 W
Figure 5B:
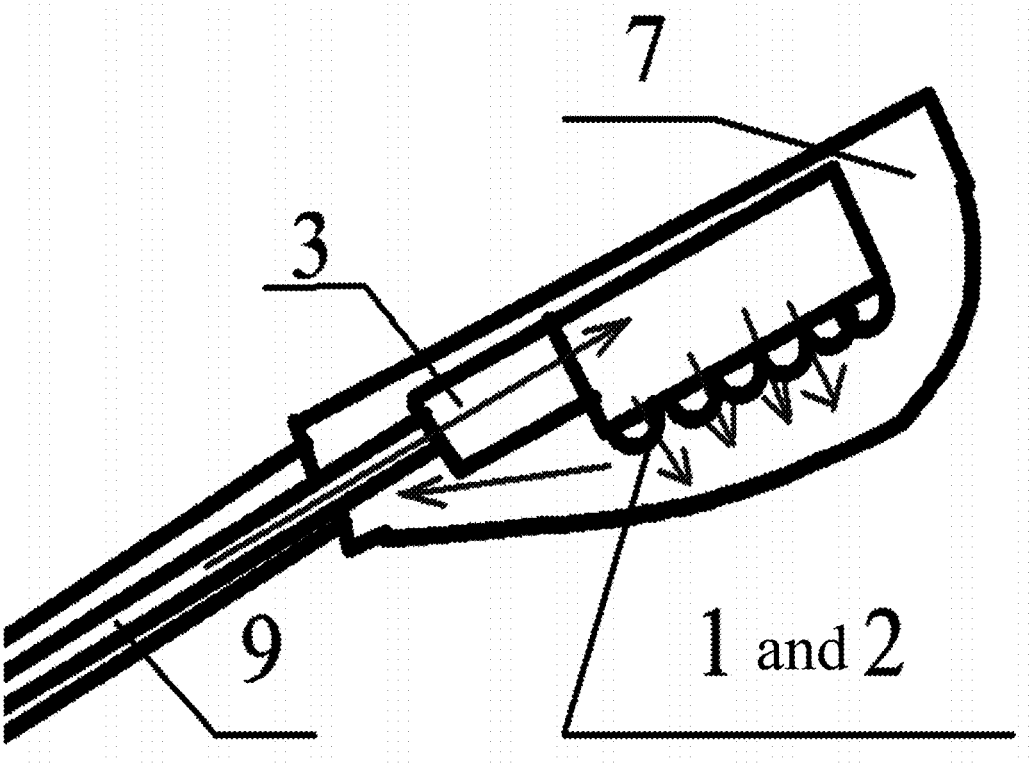

A structure of this LED lamp is shown in FIG. 3.

During steady operation, a temperature rise of a heat dissipating surface (back face) of the LED chip is less than 25 DEG C.

[Embodiment 3] A thermally conductive braided fabric 1 woven from a copper wire is disposed between a first pipe body 5 and a second pipe body 6. Air passes through a gap between the first pipe body 5 and the second pipe body 6 to carry heat away from the thermally conductive braided fabric 1. Stable heat dissipation is realized.

[Embodiment 4] An LED street lamp with a power of 100 W. A lampshade, a hollow lamppost and a plastic pipe form an enclosed ventilation passage, and heat is dissipated mainly by utilizing the lamppost. A blower blows air away from a gap of a thermally conductive braided fabric, and the blown air enters the lamppost through the lampshade, the cooled air is recirculated back to the blower through the plastic pipe, so that a circularly cooled air flow is formed. In this way, the air flow for cooling is enclosed in the lampshade and the hollow lamppost, and isolated from the outside world, so as to avoid pollution and other influences on an outdoor environment.

[Embodiment 5] Without blower fan ventilation: (30 W LED lamp)

The heat conducting wires are copper wires of copper braided strips commonly used by electricians. The copper wires are in diameter of 0.12 mm, and the braided strips are in width of about 30 mm. Three copper braided strips in 150 mm length each are obtained. The braided strips are pushed open to form a cylinder, and then the cylinder is cut open to obtain 3 groups of intertwined copper wires that form three flat surfaces in 150 mm length and 60 mm width respectively.

LED beads at a rating of 350 MA current and 3.2-3.4V voltage per bead are used for the LED chips. The heat dissipating surfaces of 30 LED beads are fixed to the copper wires of the three braided strips by soldering and bonding with thermal conductive adhesive in a way that heat can be conducted well between the heat dissipating surfaces of the LED beads and the copper wires of the braided strips. The copper wires of the three copper braided strips are suspended in the air, so that the air circulation around the copper wires is not affected.

The LED chips are connected correctly, and electric power is supplied at 30 W constant power to the LED chips. After the LED chips operate for 1 h, the temperature rise on the heat dissipating surfaces of the LED chips is measured with a thermocouple probe. The temperature rise is always smaller than 25° C. in repeated measurement processes.

[Embodiment 6] With forced ventilation by means of a blower fan: (80 W LED lamp)

In a case that the LED power is high or the heat generation is concentrated, forced ventilation by means of a blower fan should be considered. The heat conducting wires are still the copper wires of copper braided strips. The copper wires are in diameter of 0.12 mm, and the braided strips are in width of about 30 mm.

Five copper braided strips in 80 mm length each are obtained. The braided strips are pushed open to form a cylinder, and then the cylinder is cut open to obtain 5 groups of intertwined copper wires that form five flat surfaces in 80 mm length and 60 mm width respectively.

LED beads at a rating of 700 MA current and 3.2-3.4V voltage per bead are used for the LED chips. The heat dissipating surfaces of 40 LED beads are fixed to the copper wires of the five braided strips by soldering and bonding with thermal conductive adhesive in a way that heat can be conducted well between the heat dissipating surfaces of the LED beads and the copper wires of the braided strips.

The copper wires of the five copper braided strips are mounted on one end of a ventilation duct by folding, and a blower fan is mounted on the other end of the ventilation duct for ventilation. The air is blown by the blower fan to the copper wires, carries away the heat generated during the operation of the LED chips, and then flows out through the clearance between the LED chips.

The LED chips are connected correctly, and electric power is supplied at 80 W constant power to the LED chips. After the LED chips operate for 1 h, the temperature rise on the heat dissipating surfaces of the LED chips is measured with a thermocouple probe. The temperature rise is always smaller than 25° C. in repeated measurement processes.

It should be noted that the power of the blower fan required for forced ventilation is as low as a fraction of 1 Watt (the rating of the blower fan used in the examples is 12V DC 0.06A), and the required DC voltage may be obtained from the LED chip, without the need for any additional power supply.

The 80 W and 30 W LED lamps in the above two examples (Embodiment 5 and Embodiment 6) are small in volume and light in weight, and even several LED lamps can be held in one hand; in addition, the structure is very simple and easy to process. Especially, a prominent heat dissipation effect is attained; for high-power LED lamps, such as the 80 W and 30 W LED lamps, the 25° C. temperature rise, simple structure, light weight and small volume can't be achieved with any other method. Such LED lamps are still unparalleled up to now.

In summary, a large number of finest possible heat conducting material wires are used and it is sought that one sufficiently large heat-dissipation surface is obtained with fewest possible heat conducting materials. Such that:

1, the problem of the heat-dissipation of the LED is fundamentally solved in a case of ensuring that the temperature rise of the high-power LED is controlled below 25° C.;

2, So that a sufficient heat-dissipation area can be obtained with only a small amount of copper wires, which enables the mass and size of the heat-dissipation device to be reduced to a few tenths, or even a few hundredths of those of a conventional heat-dissipation device. This is undoubtedly a disruptive change to the structure of a heat-dissipation device which is usually bulky; and 3, the entire heat-dissipation device is very simple in structure and easy to process. Such a simple structure, light weight and size are unmatched by any other methods.

What is claimed is:

1. An apparatus for heat exchange by utilizing a braided fabric woven from a thermally conductive wire material, comprising:

a thermally conductive braided fabric woven from the thermally conductive wire with a diameter d, wherein 0.01 mm≤d≤2 mm; and a heat-generating or heat-absorbing object required to be subjected to heat dissipation or absorption connected onto the thermally conductive braided fabric by means of welding, adhering with a thermally conductive adhesive and casting, wherein heat can be conducted between the heat-generating or heat-absorbing object and the heat-conducting wires of the heat-conducting fabric, the heat is conducted on the thermally conductive wire of the thermally conductive braided fabric so that air is heated or cooled by the surface of the thermally conductive wire, and the heat is dissipated or absorbed by convection, and wherein the thermally conductive braided fabric comprises a metal frame, wherein the metal frame on the thermally conductive braided fabric is formed by die-casting or welding, and the heat-generating or heat-absorbing object is connected onto the metal frame of the thermally conductive braided fabric by means of welding, adhering with a thermally conductive adhesive, and casting.

2. An apparatus for heat exchange by utilizing a braided fabric woven from a thermally conductive wire material, comprising:

a thermally conductive braided fabric woven from the thermally conductive wire with a diameter d, wherein 0.01 mm≤d≤2 mm; and a heat-generating or heat-absorbing object required to be subjected to heat dissipation or absorption connected onto the thermally conductive braided fabric by means of welding, adhering with a thermally conductive adhesive and casting, and wherein heat can be conducted between the heat-generating or heat-absorbing object and the heat-conducting wires of the heat-conducting fabric, the heat is conducted on the thermally conductive wire of the thermally conductive braided fabric so that air or is heated or cooled by the surface of the thermally conductive wire, and the heat is dissipated or absorbed by convection, wherein the thermally conductive braided fabric made of the thermally conductive wire forms a pocket along or together with other materials, a blower is installed at an opening of the pocket to supply air into the pocket and blow air from a gap of the thermally conductive braided fabric, such that a heat dissipating surface of the thermally conductive wire of the thermally conductive braided fabric heat or cool air to realize effective heat dissipation or absorption.

3. An LED lighting device, comprising the apparatus for heat exchange by utilizing the thermally conductive braided fabric woven from the thermally conductive wire according to claim 1, wherein the heat-generating or heat-absorbing object required to be subjected to heat dissipation or absorption is an LED chip, and the LED chip is affixed to the thermally conductive braided fabric.

4. An LED lighting device, comprising the apparatus for heat exchange by utilizing the heat-generating or heat-absorbing braided fabric woven from the thermally conductive wire according to claim 1, wherein an LED chip, a blower, and the thermally conductive braided fabric are all enclosed in a ventilation passage comprising pipe walls made of a thermally conductive material, the blower causes an air flow to flow through a gap of the thermally conductive braided fabric to take heat away, then the air flow is cooled by the pipe walls made of the thermally conductive material in the ventilation passage and recirculated back to cool the thermally conductive braided fabric and the LED chip affixed thereon.

5. The LED lighting device according to claim 4, wherein the ventilation passage comprises a lampshade, a hollow lamppost or a support rod, and a plastic pipe, wherein the blower blows air away from a gap of the thermally conductive braided fabric, and the blown air enters the lamppost through the lampshade, the cooled air is recirculated back to the blower through the plastic pipe, so that a circularly cooled air flow is formed.

6. An LED lighting device, comprising the apparatus for heat exchange by utilizing the thermally conductive braided fabric woven from the thermally conductive wire according to claim 2, wherein the heat-generating or heat-absorbing object required to be subjected to heat dissipation or absorption is an LED chip, and the LED chip is affixed to the thermally conductive braided fabric.

7. An LED lighting device, comprising the apparatus for heat exchange by utilizing the heat-generating or heat-absorbing braided fabric woven from the thermally conductive wire according to claim 2, wherein an LED chip, a blower, and the thermally conductive braided fabric are all enclosed in a ventilation passage comprising pipe walls made of a thermally conductive material, the blower causes an air flow to flow through a gap of the thermally conductive braided fabric to take heat away, then the air flow is cooled by the pipe walls made of the thermally conductive material in the ventilation passage and recirculated back to cool the thermally conductive braided fabric and the LED chip affixed thereon.

8. The LED lighting device according to claim 7, wherein the ventilation passage comprises a lampshade, a hollow lamppost or a support rod, and a plastic pipe, wherein the blower blows air away from a gap of the thermally conductive braided fabric, and the blown air enters the lamppost through the lampshade, the cooled air is circulated back to the blower through the plastic pipe, so that a circularly cooled air flow is formed.

* * * * *